US006293061B1

(12) United States Patent
Horak, Jr.

(10) Patent No.: US 6,293,061 B1
(45) Date of Patent: Sep. 25, 2001

(54) SYSTEM AND METHOD FOR INSTALLING A JAMB

(76) Inventor: Richard Horak, Jr., P.O. Box 556, Hopatcong, NJ (US) 07843

( * ) Notice: Subject to any disclaimer, the term of this patent is extended or adjusted under 35 U.S.C. 154(b) by 0 days.

(21) Appl. No.: 09/408,489

(22) Filed: Sep. 30, 1999

(51) Int. Cl.[7] ..... E06B 1/60
(52) U.S. Cl. ..... 52/213; 52/217
(58) Field of Search ..... 52/213, 217, 210, 52/204.1

(56) References Cited

U.S. PATENT DOCUMENTS

| | | | | |
|---|---|---|---|---|
| 3,189,137 | | 6/1965 | Harris . | |
| 3,226,781 | * | 1/1966 | Schnabel | 52/213 X |
| 3,636,672 | * | 1/1972 | Fink | 52/213 |
| 4,840,002 | * | 6/1989 | Lovgren | 52/213 |
| 4,986,044 | | 1/1991 | Funari . | |
| 5,119,609 | | 6/1992 | Tait et al. . | |
| 5,692,350 | | 12/1997 | Murphy, Jr. . | |
| 5,771,644 | | 6/1998 | Kidd . | |

* cited by examiner

*Primary Examiner*—Peter M. Cuomo
*Assistant Examiner*—Michael J. Fisher
(74) *Attorney, Agent, or Firm*—Thomas L. Adams

(57) ABSTRACT

A door jamb that can be installed in a wall has an inward face facing inwardly toward the door and a peripheral face facing away from the door. The system has, in combination, a spaced plurality of clips each with an external arm and a transverse internal arm. The external arm is adapted for longitudinally directed, surficial attachment to the wall. Being adapted for its purpose, the internal arms are separately attached along the peripheral face of the jamb. Thereafter, with the jamb positioned in the wall, the jamb is plumbed and the external arms of the clips are surficially attached to the wall longitudinally.

31 Claims, 3 Drawing Sheets

FIG. 1
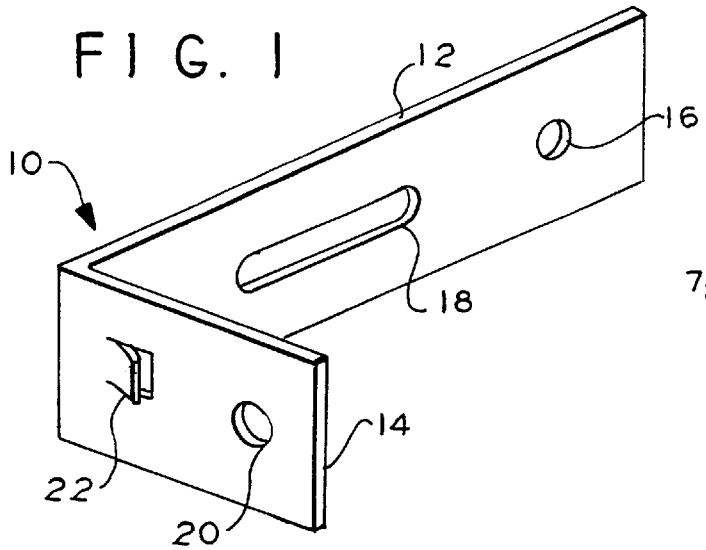
FIG. 13
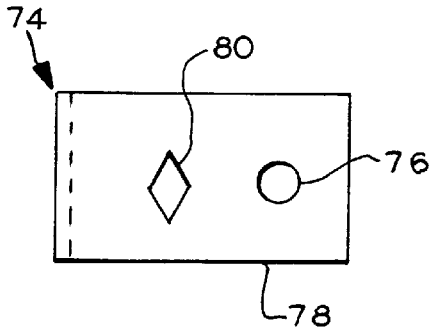
FIG. 9
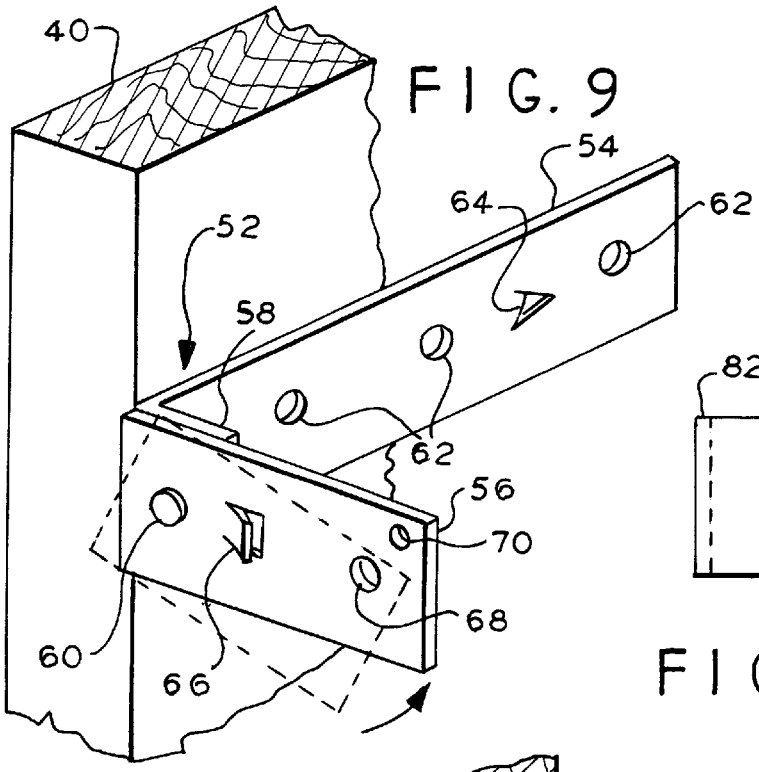
FIG. 14
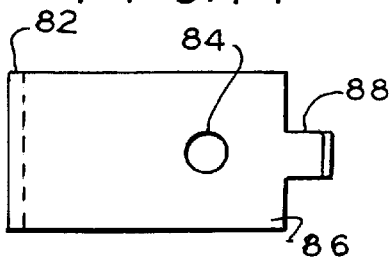
FIG. 6B
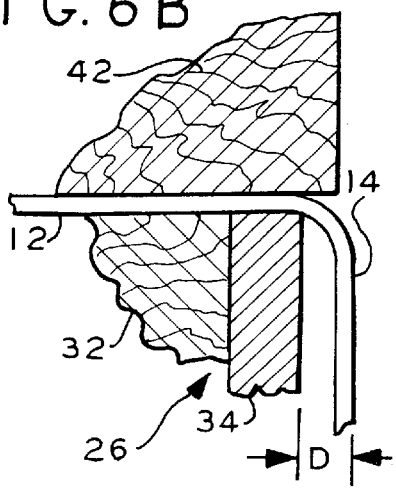
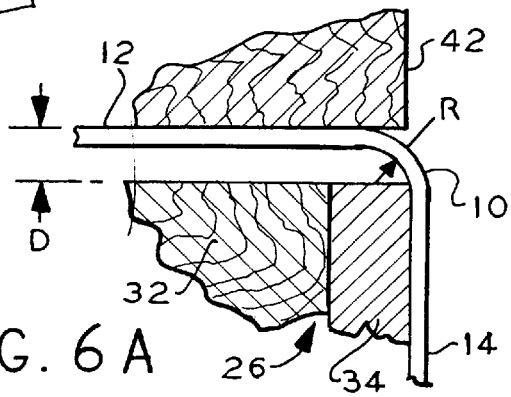
FIG. 6A

SYSTEM AND METHOD FOR INSTALLING A JAMB

BACKGROUND OF THE INVENTION

1. Field of the Invention

The present invention relates to jamb installation and for clip systems for installing such jambs.

2. Description of Related Art

Door assemblies are often packaged as a pre-hung door hinged to a prefabricated jamb, and sold as a single unit. The door is usually temporarily secured in position so it does not swing during shipment. The door jamb is ultimately installed in a rough opening that is framed with studs edged by liners. The traditional installation involves placing the door jamb in the rough opening and plumbing it. This step requires great skill since the jamb needs to be adjusted over many degrees of freedom. Also complicating matters, the door is usually left free to swing so that the installer can reach the other side in order to make adjustments or insert wedge-shaped shims.

In U.S. Pat. No. 5,119,609 a flange-like nailing fin is shown secured to the perimeter of a window frame, and described as being useful for door assemblies as well. This nailing fin can be folded from a stored position in front, to a working position along the side. The fin runs the full length and width of the window frame. To achieve adequate attachment strength the fin could be made relatively thick and therefore relatively heavy. The alternative, apparently chosen in this reference, is to make the fin thinner and provide many nail holes. Either approach however is disadvantageous.

In U.S. Pat. No. 4,840,002 an F-shaped clip has one arm embedded in the edge of a door jamb, and another arm acting as a backer for the jamb. The leg of the clip is screwed into the edge of the jamb and into a steel support stud. By screwing into the edge of the jamb and by embedding an arm into that edge, one produces an obstruction that hampers attaching trim around the door jamb. The reference deals with this problem by providing specialized tongue flanges designed to fit into customized bores in the wood trim. Therefore, one cannot use standard door trim.

In U.S. Pat. No. 3,189,137 a J-shaped clip is pressed into an extruded door frame before being nailed to a support wall. This clip has an arm that extends away from the wall and therefore would interfere with standard door trim. This clip is only appropriate with the nonstandard support wall and extruded door frame disclosed in this reference.

See also U.S. Pat. Nos. 4,986,044; 5,692,350; and 5,771,644.

SUMMARY OF THE INVENTION

In accordance with the illustrative embodiments demonstrating features and advantages of the present invention, there is provided a system for installing in a wall a jamb for a door. The jamb has an inward face facing inwardly toward the door and a peripheral face facing away from the door. The system has, in combination, a spaced plurality of clips each having an external arm and a transverse internal arm. The internal arm is adapted for attachment to the peripheral face of the jamb. The external arm is adapted for longitudinally directed, surficial attachment to the wall.

According to another aspect of the invention a method employing clips is provided. The clips each have an external arm and a transverse internal arm for installing in a wall a door jamb. The jamb has an inward face facing inwardly toward the door and a peripheral face facing away from the door. The method includes the step of separately attaching the internal arms of the clips at spaced positions along the peripheral face of the jamb. Another step is positioning the jamb in the wall. The method also includes the step of plumbing the jamb and surficially attaching the external arms of the clips to the wall longitudinally.

By employing a system and method of the foregoing type, installation of door jambs is greatly facilitated, especially for pre-hung doors. In one preferred embodiment, a clip can have a long arm designed for attachment to a jamb, and a short transverse arm designed for attachment to a wall. The preferred clip can be fairly thin and have fairly tight bending radiuses, so that the clip can be mounted flush without obstructing the installation of trim. Preferably, the long arm will be first installed on the jamb before attempting to install the jamb in a rough opening. In some embodiments the long arm can be temporarily secured to the jamb by a prefabricated, pointed tang that was struck from the long arm.

In one preferred clip, the short arm has a mark for orienting a level to determine whether the jamb is plumb. This mark can be made by inking, engraving, or by striking a tab out of the arm. In one highly preferred embodiment, the short arm can swing semaphore-like. Accordingly, the long arm can be secured to the jamb, and the short arm can be swung back to overlap the jamb and door. In this position, the short arm can be held against the edge of the jamb to establish the depth of insertion of the long arm along the jamb before securing the long arm to the jamb. In some instances, the short arm can then be tacked to the door to secure it for transportation.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIG. 1 is a perspective view of a clip for a system and method in accordance with the principles of the present invention;

FIGS. 6A and 6B are detailed cross-sectional views showing the effect on tolerances if the clip has appreciable rounding at its bend;

FIG. 9 is a detailed, perspective view of the clip of FIG. 7 positioned against a jamb;

FIG. 13 is an elevational view of the short arm of a clip that is an alternate to that of FIG. 1; and FIG. 14 is an elevational view of the short arm of a clip that is an alternate to that of FIG. 13.

DETAILED DESCRIPTION OF THE PREFERRED EMBODIMENTS

Figure 2:
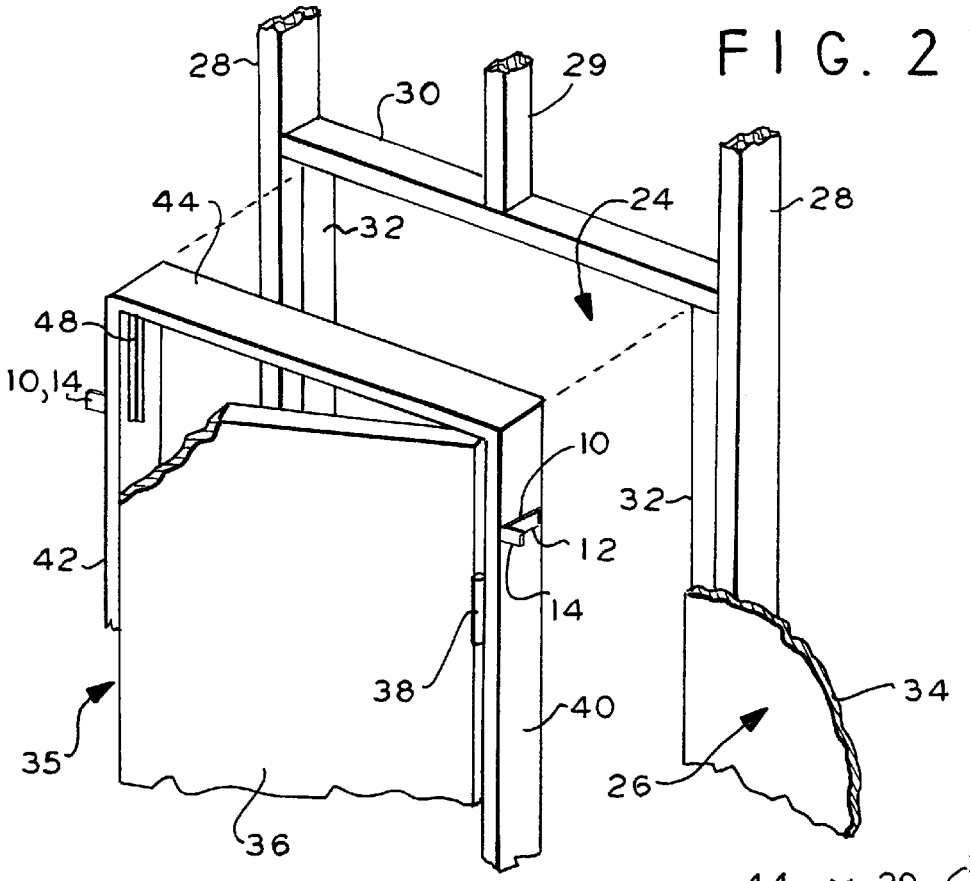
FIG. 2 is a partial, perspective view of a rough opening in a wall about to receive a door jamb fitted with the clips of FIG. 1.
Figure 4:
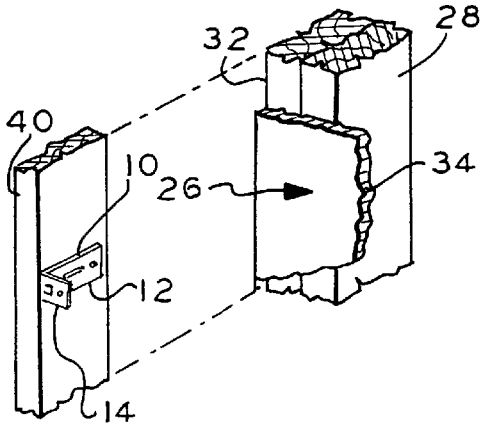
FIG. 4 is a detailed perspective view of the installation of one of the clips of FIG. 1.
Figure 3:
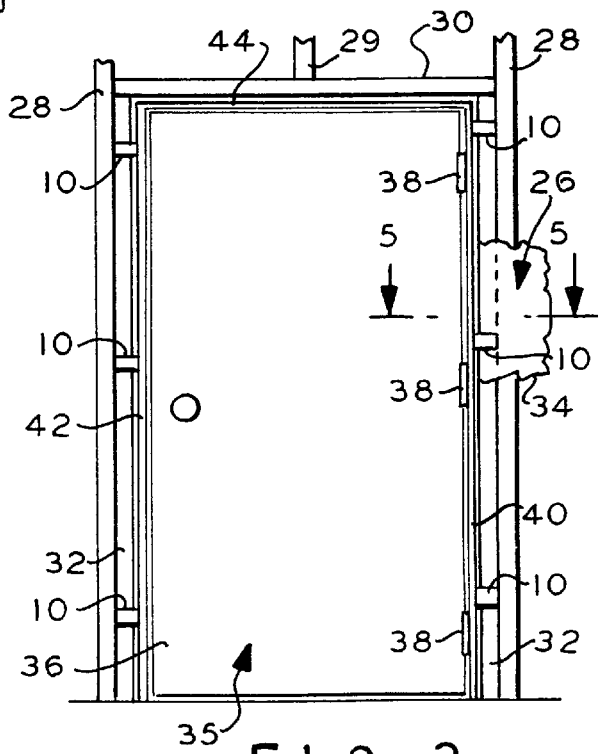
FIG. 3 is an elevational view of the door jamb of FIG. 1 installed in the rough opening.

Referring to FIG. 1, the illustrated clip 10 is one of a plurality of clips that are used as part of a system for installing a jamb. A relatively long, internal arm 12 is integrally formed with a relatively short, external arm 14. Arms 12 and 14 each have a circular fastener hole 16 and 20, respectively. Arm 12 has a fastener slot 18.

Tab 22 is punched or struck from arm 14 to act as an indicia or plumb means. As described further hereinafter, a level can be pressed against tab 22 to determine whether the jamb attached to clip 10 is plumb. Instead of a punched tab, other embodiments may use an inked or engraved indicia.

Referring to FIGS. 2–5, a rough opening 24 in wall 26 is framed by studs 28 and a header 30 supported by liners 32. Header 30 can support an additional stud 29. Wall 26 is covered in the usual fashion by sheet rock 34 or the like. While only a fragment of sheet rock 34 is illustrated, in actual embodiments it will cover the studs 28 and 29, as well as liners 32 and header 30. A pre-hung door 36 is shown attached by hinges 38 to a door frame assembly, including jambs 40 and 42, and door frame header 44, to form an assembly 35. Doors stops 46 and 48 are secured to the inward faces of jambs 40 and 42. A similar door stop (not shown) is secured to the inward face of header 44.

In this embodiment six clips as shown in FIG. 1 have their internal arms 12 attached to the peripheral faces of the jambs, three on jamb 40 and three on jamb 42. It will be understood that a different number of clips may be used in other embodiments, depending upon the desired strength, rigidity, speed of installation, etc. Each of the clips are positioned with the internal arms 12 at right angles to the length of the jambs, and with the outside face of external arm 14 substantially flush with the edges of the jambs 40 and 42.

The installer can initially secure the internal arm 12 through slot 18 with a nail 49. Slot 18 allows a substantial amount of adjustment. Thereafter, the installer can fix the clip 10 in place by nailing through hole 16 and, optionally, placing an additional nail through slot 18. Instead of nails, the installer may use screws, staples, or other fastening devices. While avoiding an overlapping placement at the same height as a hinge or other door hardware, two of the clips 10 will be placed near the top of the jambs, two near the bottom, and two near the middle. The top and bottom clips may be spaced 15 cm from the top and bottom, although other spacings are contemplated.

Next, door assembly 35 is positioned in the rough opening 24 with the external arms 14 placed flush against wall 26. Next, the installer will slightly lift an upper corner of the door assembly 35 (for example, where clip 10 is closest to the top hinge 38) by inserting a pry bar or other lifting lever under the assembly. This top clip may now be nailed into place using fastener hole 20 of external arm 14. The installer may now place a level against the tabs 22 (FIG. 1) of the top and bottom clip 10, and make adjustments to ensure that clips 10 and therefore jamb 40 are plumb. The installer will now nail bottom clip 10 in place. This procedure will now be repeated with the top and bottom clip 10 on knob-side jamb 42. Next, the two middle clips 10 will be nailed in place through their fastener holes 20. At this time, the installer may wish to hammer tabs 22 flush, so they no longer protrude and will not interfere with the trim installation, to be described presently.

Significantly, this procedure is performed without shims and without the need to open door 36.

The installer may now nail trim pieces 50 to cover the border of wall 26 and the edges of jambs 40 and 42. An important feature of clips 10 is that they are arranged to remain substantially flush and do not obstruct or interfere with the installation of trim pieces.

Referring to FIG. 6A, jamb 42 is positioned to be substantially co-planar with the outside surface of sheet rock 34 of wall 26. Arms 12 and 14 are nailed to and therefore flush with jamb 42 and sheet rock 34, respectively. The transition between arms 12 and 14 is shown occurring with a bend radius R, which is somewhat exaggerated for illustrative purposes. To accommodate the bend radius, arm 12 must be spaced at least the distance R from the edge of sheet rock 34 of wall 26. When the thickness of arm 12 is added, the minimum separation between wall 26 and jamb 42 is distance D. If one were to attempt to bring jamb 42 adjacent to wall 26, jamb 42 would need to the shifted outwardly as shown in FIG. 6B, in which case arm 14 will not lie flush against sheet rock 34. Instead, arm 14 would be separated by previously mentioned distance D. Thus the jamb would be misaligned and the arm 14 would be difficult to secure to the wall 26.

For this reason, in the preferred embodiment arms 12 and 14 are made relatively thin, preferably about ⅛ inch (3.2 mm), or less. Also, the bend radius R is also made relatively small, preferably about ⅛ inch (3.2 mm), or less. It is important to keep these dimensions relatively small so that the jamb can be brought relatively close to the wall, if needed: otherwise, adjustment of the jamb will be rather restricted.

Figure 8:
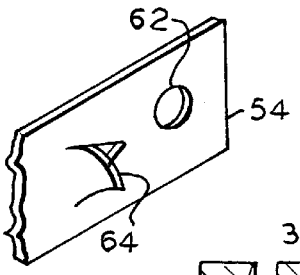
FIG. 8 is a fragmentary, detailed perspective view of the distal end of the long arm of the clip of FIG. 6.
Figure 5:
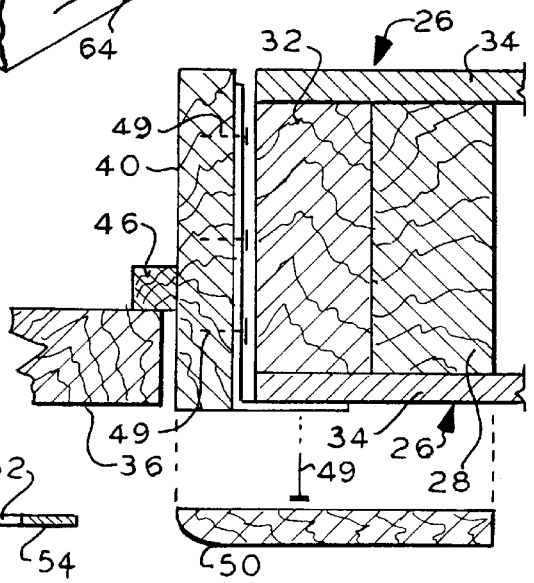
FIG. 5 is a cross-sectional view taken along line 5—5 of FIG. 3.
Figure 7:
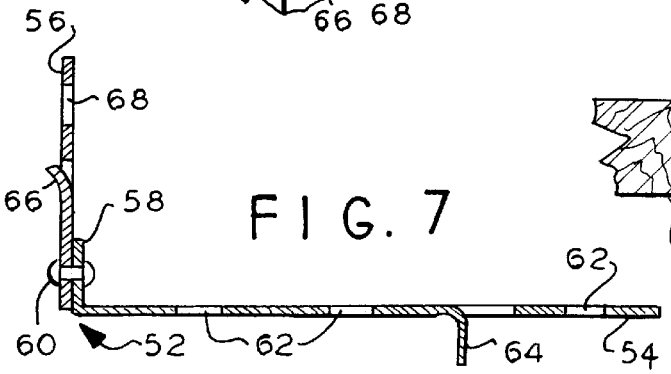
FIG. 7 is a cross-sectional view of a clip that is an alternate to that of FIG. 2.

Referring to FIGS. 7–9, an alternate clip 52 is shown with an internal arm 54 whose proximal end is bent into a stub 58. External arm 56 is a swing member of that is pivotally attached to stub 58 by means of rivet 60. FIG. 9 shows this pivoting feature by showing in phantom, rotation from an alternate position for arm 56.

Arm 56 has a fastener hole 68 and a tab 66 similar to the ones previously shown in FIG. 1 (e.g., tab 22). Arm 56 also has a tacking hole 70, used for purposes to be described presently.

Arm 54 is shown with three spaced fastener holes 62. A pointed tang 64 is punched out of arm 54 arm between the two outermost ones of the holes 62. Tang 64 is a triangular element that is bent outwardly at a right angle from arm 54. As will be described presently, tang 64 can be embedded into the jamb to temporarily secure arm 54.

Figure 10:
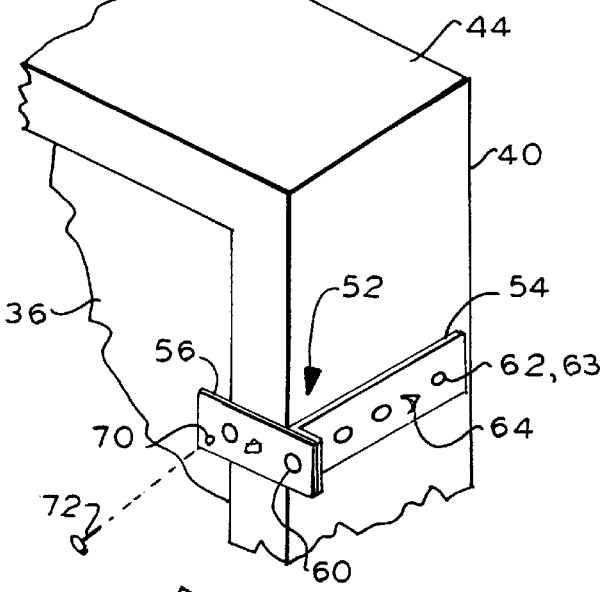
FIG. 10 is a perspective view of the clip of FIG. 7 installed on a door jamb with the short arm swung back over the edge of the jamb.
Figure 12:
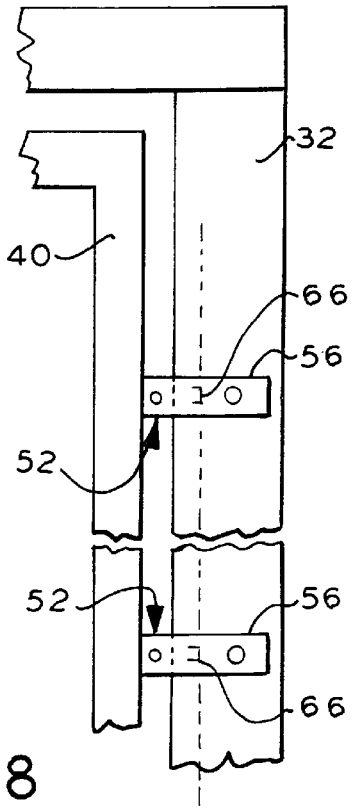
FIG. 12 is a fragmentary, elevational view of the assembly of FIG. 9 installed in a rough opening.

Referring to FIG. 10, arm 56 is shown rotated 180° from the position shown in FIG. 7. Consequently, arm 56 can be pressed along the edge of jamb 40 to determine the insertion depth of arm 54. With clip 52 positioned as shown, a hammer may be struck against tang 54, embedding it in jamb 40 temporarily. Thereafter, nails 63 may be hammered through fastener holes 62 to permanently secure arm 54 to jamb 40.

As previously mentioned, jamb 40 is part of a door assembly having pre-hung door 36. In some instances, clip 52 may be installed on the door assembly by the original equipment manufacturer. In that case, arm 56 can be tacked to door 36 by hammering tack 72 through tacking hole 70 into door 36. Consequently, door 36 will be held in place and will not swing during shipment. Also, when the door assembly is delivered, its outline will be relatively compact. In preferred embodiments, the door assembly can be squarely pushed through a rough opening, since arm 56 does not extend excessively from the peripheral face of jamb 40.

Figure 11:
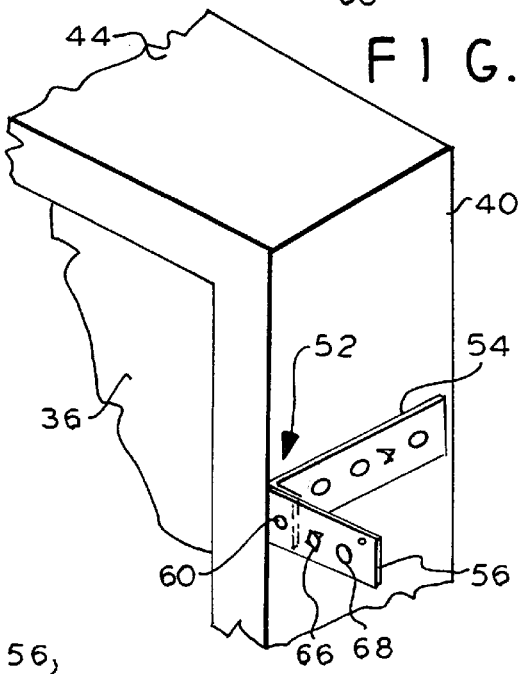
FIG. 11 is a perspective view similar to that of FIG. 10, but with the short arm swung away from the jamb.

Referring to FIG. 11, arm 56 was untacked from door 36 and swung 180° to extend outwardly and perpendicularly from the peripheral face of jamb 40. Thus positioned, clips 52 can be used for installing the door assembly in the same manner described in connection with the embodiment of FIGS. 1–5.

Referring to FIG. 13, a clip 74 is shown, which is an alternate to that of FIG. 1. Clip 74 is shown with a fastener hole on its shorter, external arm 78. Instead of the previously mentioned tab (tab 22 of FIG. 1) external arm 78 has a diamond-shaped hole 80 punched therein. The installer can visually align the edge of a level with this diamond to determine whether the assembly is plumb. Alternatively, the installer can align the string of a plumb bob with diamond-shaped holes 80.

Referring to FIG. 14, an alternate clip 82 is shown with a fastener hole 84 in its external arm 86. In this embodiment, the previously mentioned plumb means is replaced with a hook-like projection 88 that is stamped from the body of clip 82. As before, a level can be pressed against the tip of projection 88 to determine whether the assembly is plumb.

It is appreciated that various modifications may be implemented with respect to the above described, preferred embodiment. While the clips of the preferred embodiment are steel stampings, in other embodiments the clips can be made by molding, machining, or otherwise fashioning other metals, plastics, or other materials. Furthermore, alternate clips can be made from a number of discrete components that can be made from different materials to form a composite. In some embodiments, the inside corner between the internal and external arms of the clip can be relieved to provide additional clearance. In addition, the number and the shape of the various fastening holes can be varied depending upon the requirements of a particular application. Moreover, the shape of the arms need not be rectangular but can be rounded or may be broken into Y-shaped or T-shaped branches. Additionally, the foregoing installation steps can be supplemented with additional steps or the steps can be performed in a different order depending upon the circumstances.

Obviously, many modifications and variations of the present invention are possible in light of the above teachings. It is therefore to be understood that within the scope of the appended claims, the invention may be practiced otherwise than as specifically described.

What is claimed is:

1. A system for installing in a wall a jamb for a door, said jamb having an inward face facing inwardly toward said door and a peripheral face facing away from said door, the system comprising, in combination:

a spaced plurality of clips each having an external arm and a transverse internal arm, said internal arm having two fastening holes adapted for attachment to the peripheral face of said jamb, said external arm being adapted for longitudinally directed, surficial attachment to said wall, each of said clips including:

plumb means for determining whether said jamb is plumb, said plumb means having an indicia on said external arm for alignment with a leveling tool, and including a deformation on said external arm against which the leveling tool can be aligned.

2. A system according to claim 1 wherein said plurality of clips are at least four in number and are adapted to be distributed in equal numbers on the left and right of the jamb.

3. A system according to claim 2 comprising:

a plurality of trim pieces adapted to be attached over said external arms of said clips to straddle said wall and said jamb.

4. A system according to claim 1 wherein said plurality of clips are six in number and are adapted to be distributed in equal numbers the left and right of the jamb.

5. A system according to claim 1 wherein the internal arm of said clip is adapted to be attached flat against said peripheral face, said clip being sized to allow said jamb and said external arm to be mounted substantially flush with said wall, notwithstanding that said internal arm may be contiguous to said peripheral face and abut said wall, so that trim can be secured at said wall and said jamb over said external arm.

6. A system according to claim 5 wherein said clips are sized to allow said jamb and said external arm to be coplanar with said wall to within a tolerance of ⅛ inch.

7. A system according to claim 5 wherein the internal and the external arms of said clips have a thickness of less than ⅛ inch.

8. A system according to claim 1 wherein said external arm has a fastener hole located distally relative to said plumb means.

9. A system according to claim 1 wherein each of said clips has on said external arm at least one fastener hole.

10. A system according to claim 9 wherein said at least one fastening hole of the internal arm of each of said clips comprises an elongated slot.

11. A system according to claim 9 wherein the internal arm of each of said clips has a tang struck therefrom, said tang being adapted to be secured into the peripheral face of said jamb by being embedded.

12. A system according to claim 1 wherein said external arm comprises:

a swing member mounted to articulate in a plane transverse to said internal member.

13. A system for installing in a wall a jamb for a door, said jamb having an inward face facing inwardly toward said door and a peripheral face facing away from said door, the system comprising, in combination:

a spaced plurality of clips each having an external arm and a transverse internal arm, said internal arm having two fastening holes adapted for attachment to the peripheral face of said jamb, said external arm being adapted for longitudinally directed, surficial attachment to said wall, said external arm comprising:

a swing member mounted to articulate in a plane transverse to said internal member, said swing member being swingable 180° to allow said swing member to be alternatively locatable against the wall and against the jamb.

14. A system according to claim 13 wherein said swing member has at least one fastener hole.

15. A system according to claim 14 wherein said swing member has a tacking hole smaller than said fastener hole and sized to allow temporary tacking of said swing member to the door in said jamb.

16. A system according to claim 13 wherein said external arm comprises:

a stub perpendicularly affixed to said internal arm, said swing member being pivotally attached to said stub, said stub being shorter than said internal arm and said swing member.

17. A system for installing in a wall a jamb for a door, said jamb having an inward face facing inwardly toward said door and a peripheral face facing away from said door, the system comprising, in combination:

a spaced plurality of clips each having an external arm and a transverse internal arm, said internal arm having two fastening holes adapted for attachment to the peripheral face of said jamb, said external arm being adapted for longitudinally directed, surficial attachment to said wall, said external arm comprising:

a swing member mounted to articulate in a plane transverse to said internal member, said swing member being swingable 180° to allow said swing member to swing between an extended and a retracted position, in said retracted position said external arm providing clearance to allow said jamb with clips attached thereto to pass squarely through a rough opening in said wall without interference from said clips.

18. A method employing clips each with an external arm and a transverse internal arm for installing in a wall a door jamb with fasteners, said jamb having an inward face facing inwardly toward said door and a peripheral face facing away from said door, the method comprising the steps of:

separately attaching the internal arms of said clips at spaced positions along the peripheral face of said jamb by driving the fasteners inwardly through said internal arm and into said jamb;

positioning said jamb in said wall;

plumbing said jamb; and surficially attaching the external arms of said clips to said wall longitudinally, after the internal arms have been attached to the peripheral face of the jamb.

19. A method according to claim 18 comprising the step of:

fastening trim over said external arms and adjacent to said wall and said jamb.

20. A method according to claim 19 wherein the step of surficially attaching the external arms is performed by bringing said external arm and said jamb substantially flush with said wall.

21. A method according to claim 18 wherein said internal arms each have a pointed tang, the step of separately attaching the internal arms includes the steps of:

temporarily attaching said internal arm to said jamb by embedding said tang into said jamb; and securely attaching said internal arm to said jamb without depending upon said tang.

22. A method according to claim 18 wherein said external arms each have a swing member mounted to articulate in a plane transverse to said internal arms, the method comprising the step of:

swinging said swing member away from said jamb before the step of surficially attaching said external arm.

23. A method according to claim 22 comprising the step of:

swinging away from the jamb the swing member of four of said clips located closest to corners of said jamb before swinging the rest;

plumbing the jamb by plumbing the four clips located closest to corners of said jamb; and securing the four clips to said wall before the rest.

24. A method according to claim 22 comprising the step of:

swinging the swing member of at least some of said clips away from said jamb; and plumbing the jamb by plumbing at least some of the clips.

25. A method according to claim 24 wherein each of said clips has an indicia, the step of plumbing at least some of the clips being performed by:

setting a vertical alignment between the indicia using a plumbing tool.

26. A method according to claim 24 wherein each of said clips has an tang, the step of plumbing at least some of the clips being performed by:

setting a vertical alignment between the clips by positioning a plumbing tool against the tang of at least two of said clips.

27. A method according to claim 26 comprising the step of:

bending the tangs into a flush position after the step of surficially attaching said external arm.

28. A method according to claim 18 wherein said external arms each have a swing member mounted to articulate in a plane transverse to said internal arms, the method comprising the step of:

swinging said swing member of each of said external arms toward said jamb and resting said swing member on said jamb to establish an insertion depth for said internal arms of said clip before the step of separately attaching said internal arms.

29. A method according to claim 18 wherein said external arms each have a swing member mounted to articulate in a plane transverse to said internal arms, said jamb having a door hinged therein, the method comprising the step of:

swinging said swing member toward said jamb and tacking said swing member to said door to secure it during movement of said jamb.

30. A method according to claim 29 comprising the step of:

untacking said swing member and swinging it away from said jamb before the step of surficially attaching said external arms.

31. A method according to claim 29 comprising the step of:

passing said jamb with said clips attached squarely through a rough opening in said wall.

* * * * *